United States Patent [19]

Tonel et al.

[11] Patent Number: 4,809,448

[45] Date of Patent: Mar. 7, 1989

[54] SKI BOOT

[75] Inventors: Valerio Tonel, Barbisano; Mario Mattiuzzo, Treviso, both of Italy

[73] Assignee: NORDICA S.p.A., Montebelluna, Italy

[21] Appl. No.: 90,883

[22] Filed: Aug. 28, 1987

[51] Int. Cl.[4] ..... A43B 5/04

[52] U.S. Cl. ..... 36/120; 36/121

[58] Field of Search ..... 36/117–121

[56] References Cited

U.S. PATENT DOCUMENTS

| | | | |
|---|---|---|---|
| 4,455,768 | 6/1984 | Salomon | 36/121 |
| 4,577,420 | 3/1986 | Petrini et al. | 36/117 |
| 4,653,205 | 3/1987 | Koch | 36/117 |
| 4,685,225 | 8/1987 | Hensler | 36/117 |

FOREIGN PATENT DOCUMENTS

| | | | |
|---|---|---|---|
| 172158 | 2/1986 | European Pat. Off. | 36/117 |
| 0217423 | 4/1987 | European Pat. Off. | 36/117 |
| 2557776 | 7/1985 | France | 36/117 |

*Primary Examiner*—James Kee Chi

*Attorney, Agent, or Firm*—Guido Modiano; Albert Josif

[57] ABSTRACT

Ski boot composed of at least one front quarter connected to a shell wherein a substantially transverse slot is provided on the upper portion of the front quarter and is provided with means for determining the inclination of the front quarter, said means acting by varying the working span of the slot and therefore the degree of deformability of the quarter at that point.

6 Claims, 3 Drawing Sheets

SKI BOOT

BACKGROUND OF THE INVENTION

The present invention relates to a ski boot, particularly of the rear-entry type.

In such types of currently known boots the problem is felt of allowing the forward flexing of the leg while skiing.

For this purpose, ski boots are known which are provided, at the foot instep region, with a transverse slot whereto are associated one of more movable sliders: this slot allows the front quarter to bend during the flexing phase, but the tibia rests on said quarter in a region which, during this phase, is reduced to a point, since the rotation of said quarter does not coincide with the natural rotation of the leg.

This situation causes concentrated pressures and therefore pain at the tibia.

As a partial solution to this disadvantage, it is known to provide on the front quarter, at its upper end, a slot along an axis of the shell.

During flexing, the flaps of the slot divaricate, allowing the tibia to advance, but even this solution is not free from disadvantages since, though the maximum pressure area at the upper part of the flaps of the slot, is divided into two parts, these parts still remain a concentrated area of support for the tibia which still cause pain to the skier.

SUMMARY OF THE INVENTION

The aim of the present invention is therefore to eliminate the disadvantages described above in known types, by devising a ski boot which ensures the resting and the constant adaptation of the tibia during all the phases of skiing and in particular during its forward flexing.

Within the scope of the aim described above, an important object is to obtain a ski boot which adds to the preceding characteristic that of absorbing the impact of the tibia during the flexing phase, ensuring an elastic return thereof during the extension phase.

Another important object is to provide a ski boot which associates with the preceding characteristics that of avoiding points of concentrated pressure for the tibia during the various phases of skiing, said boot furthermore allowing the natural rotation of the leg during flexing.

The aim and the objects described above, as well as others which will become apparent hereinafter, are achieved by a ski boot comprising at least one front quarter connected to a shell, characterized in that it comprises at least one slot provided on said front quarter proximate to its upper end, and means adapted for determining the inclination of said quarter with respect to said shell and for defining the working span of said slot, said working span determining the degree of deformability of said front quarter at said slot.

Advantageously said front quarter is composed of two separate elements hinged to one another.

BRIEF DESCRIPTION OF THE DRAWINGS

Further characteristics and advantages of the invention will become apparent from the detailed description of a particular, but not exclusive, embodiment, illustrated only by way of non-limitative example in the accompanying drawings, wherein.

DESCRIPTION OF THE PREFERRED EMBODIMENTS

Figure 1:
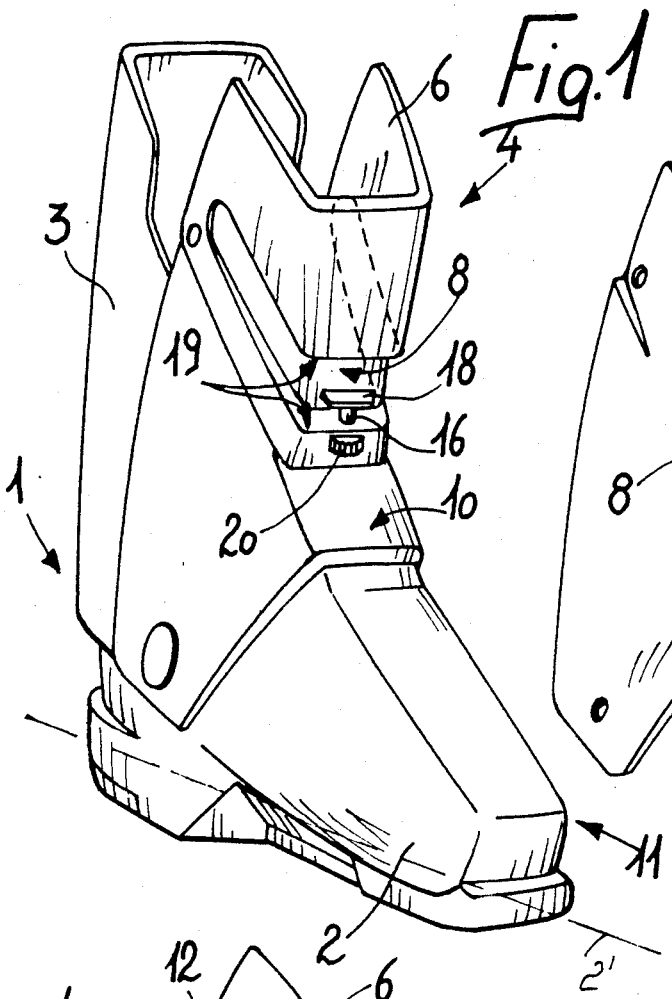
FIG. 1 is a perspective view of a ski boot according to the invention.
Figure 2:
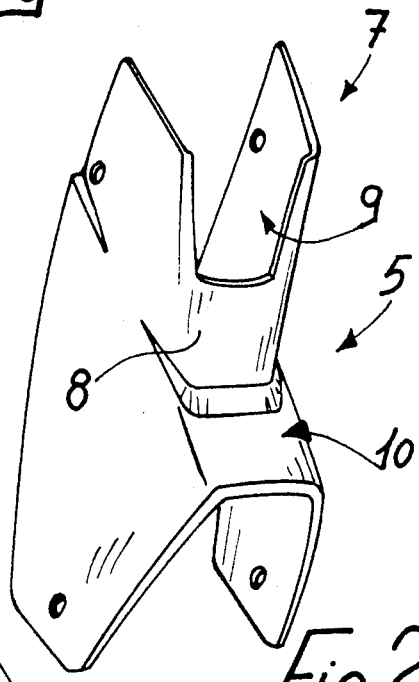
FIG. 2 is a perspective view of a component element of the front quarter.
Figure 4:
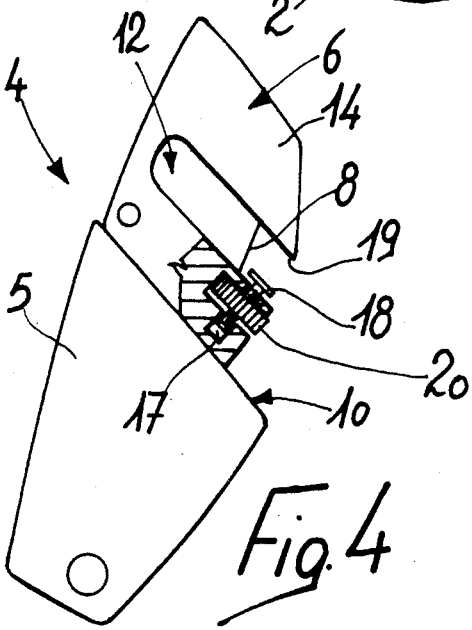
FIG. 4 is a lateral elevation view, in partial cross section, of the front quarter.
Figure 3:
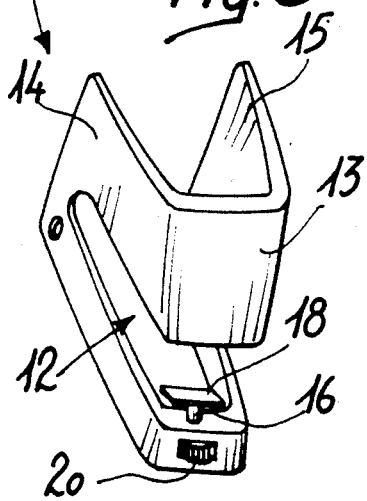
FIG. 3 is still a perspective view of another component element of the front quarter.

With reference to the above described figures, the ski boot 1 is provided with a shell 2 whereto are articulated a rear quarter 3 and a front quarter 4.

The front quarter 4 is advantageously composed of a first spoiler 5 articulated to the shell 2, and of a second spoiler 6 which embraces and is associated with said first spoiler 5 at and laterally to the upper end 7 of the latter.

Conveniently, the second spoiler 6 is made of materials having greater elastic characteristics than those of the first spoiler 5.

The latter is advantageously provided, at its front region 8, with an opening 9 adapted to allow the tibia to interact with the second spoiler 6.

The latter, once it is associated with the first shinpad 5, rests on an adapted planar surface 10 provided on said first spoiler 5 which projects from said front region 8 towards teh tip 11 of the boot 1.

On said second spoiler 6 a slot 12 is provided which affects both the front wall 13 and the lateral walls 14 and 15.

At said lateral walls the slot 12 is inclined by an acute angle with respect to the longitudinal axis 2' of the shell 2, while at the front wall 13 it is arranged approximately transversely to said shell.

That inclined configuration, with respect to the base plane of the boot 1, enures a constant resting surface for the tibia at the wall 13 of the second spoiler 6 during the flexing phase, since the slot 12 deformates elastically and absorbs the impact of the tibia thereon.

The span of said slot 12 is constant in this particular embodiment, but it can vary according to the specific requirements.

Means are furthermore associated with the second spoiler 6 which are adapted to limit its deformation during the flexing phase, said means consisting of a threaded stem 16 slideably accommodated within a seat 17 provided perpendicularly on said second spoiler 6 at its end adjacent to the front region 8 of the first spoiler 5 and overlying the planar surface 10 thereof.

Said stem 16 protrudes at the slot 12, with its end there being rigidly associated a small plate 18 arranged parallel to, and interacting with, at least the overlying one of the perimetral borders 19 defined by said slot.

Said stem 16 is rotatably associated with a complmentarily threaded ring 20 accommodated in an adapted seat provided on the second spoiler 6 and partially protruding therefrom in the direction of the tip 11 of the boot 1.

By acting on the ring 20 the skier can continuously vary the span of the slot 12 at the front region 8 of the first spoiler 5, thus varying the deformation which can be imparted to said second spoiler 6.

During the forward flexing of the leg, it is furthermore observed that, by virtue of the presence and of the inclined arrangement of the slot at the lateral walls 14 and 15, the second spoiler 6 performs a rotation by elastic deformation which has a smaller radius than that of the first spoiler 5, this allowing not only the natural rotation of the leg during flexing but also allowing to keep the tibial pressure essentially constant during said flexing phase.

In such condition, the tibia furthermore rests on a wide surface constituted by the front wall 13 of the second spoile 6.

It has thus been observed that the invention achieves the aim and the objects intended, ensuring the support and the constant adaptation of the tibia during all the phases of skiing, including the extension phase wherein the return of the second spoiler 6 accompanies and facilitates the movement of said tibia.

Figure 5:
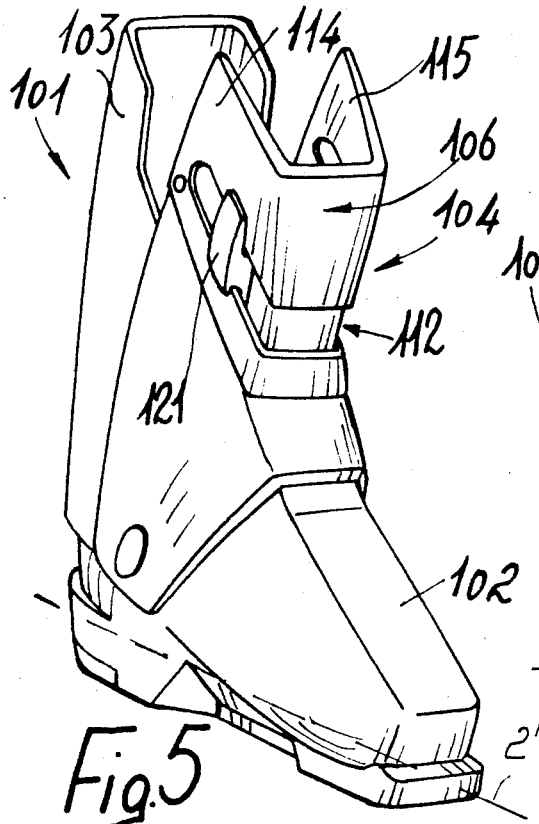
FIG. 5 is a perspective view of a boot according to another aspect of the invention.
Figure 6:
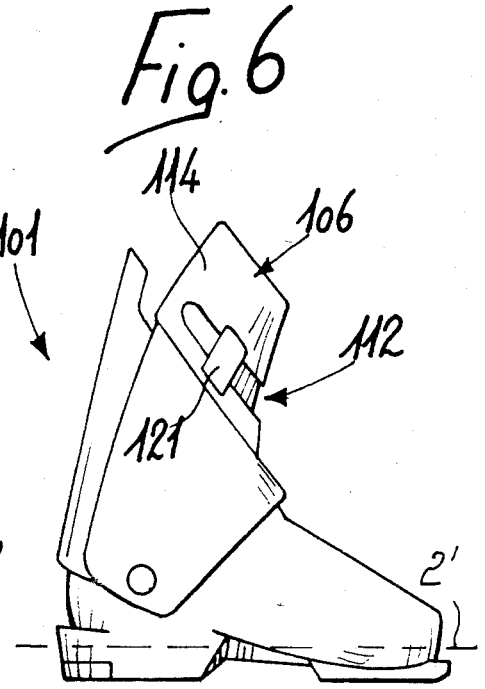
FIG. 6 is a lateral elevation view of the boot of FIG. 5.

FIGS. 5 and 6 illustrate a boot 101 substantially identical to the boot 1, the only difference being that the means for determining the deformation of the front quarter 104 consist of sliders 121 movable in the slot 112 provided in the second spoiler 106.

The sliders 121 are preferably two, one for each lateral wall 114 and 115 of the upper spoiler 106, and by moving them along the lateral flaps of the slot 112 they limit the working span of said slot in the front region.

Figure 8:
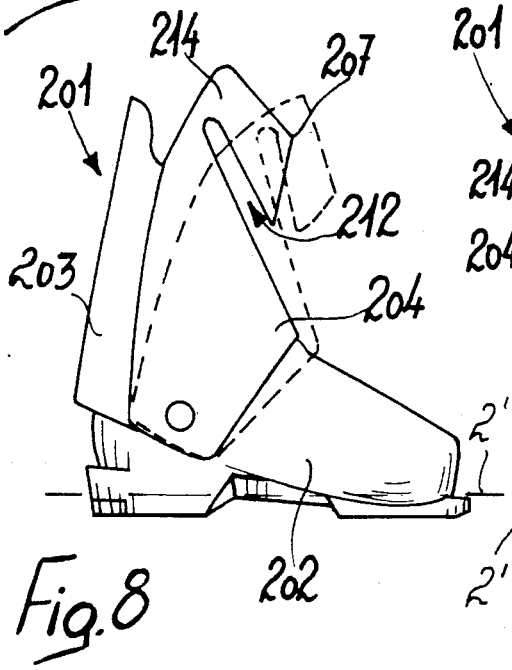
FIG. 8 is a lateral elevation view of the boot of FIG. 7.
Figure 7:
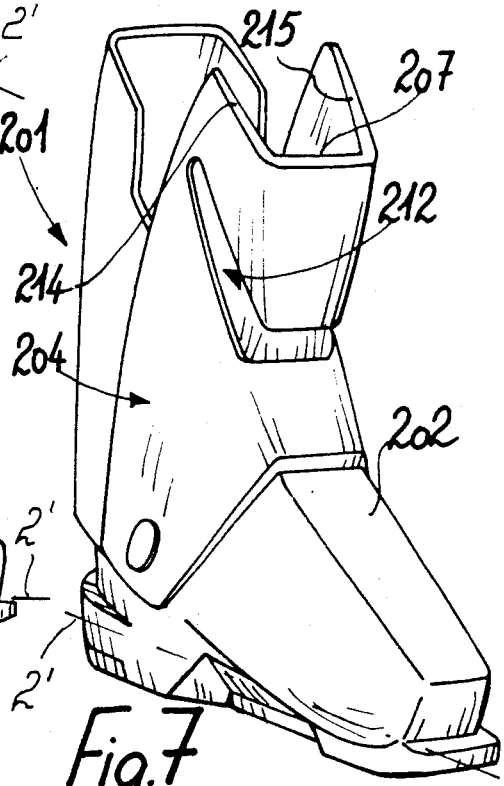
FIG. 7 is a perspective view of a boot according to a third aspect of the invention.
Figure 10:
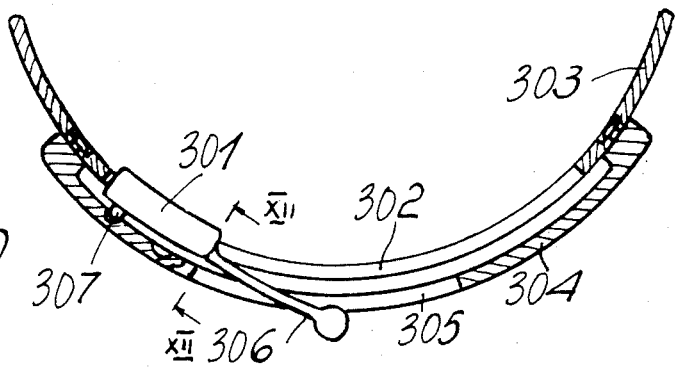
FIG. 10 is a cross section plan view of the quarter of FIG. 9.

FIGS. 7 and 8 illustrate a different embodiment of the front quarter 204 of a boot 201.

In this case the front quarter 204 is made of one piece and a slot 212 is provided at its upper portion 207 and is arranged, at the lateral walls 214 and 215 of the front quarter 204, along an axis which is inclined with respect to the longitudinal axis of the shell 202.

FIGS. 9–12 illustrate the front quarter 303 of boot according to yet another aspect of the invention, provided with means for limiting the deformation of the quarter which consist of a small block 301 which accommodates in the slot 302 provided transversely with respect to the front quarter 303 of a ski boot proximate to its upper portion.

The small block 301 is slideable inside the slot 302 and is configured so as to remain firmly coupled to the border of said slot.

Figure 9:
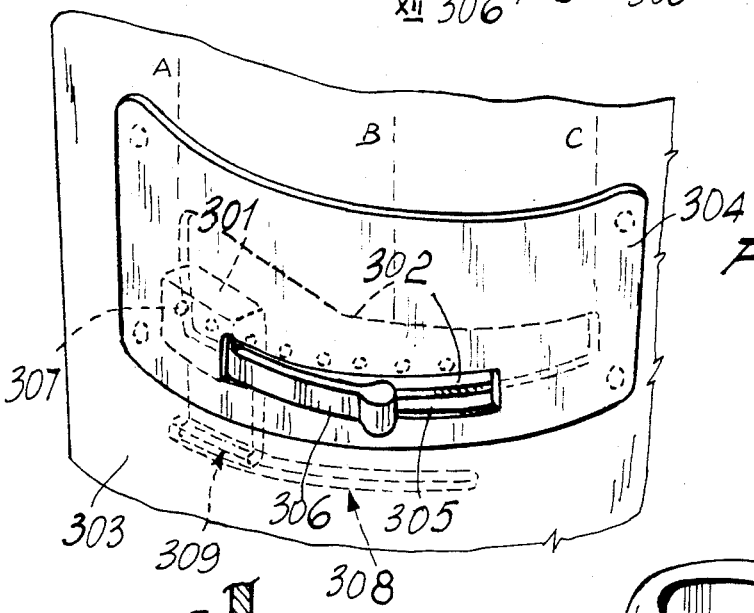
FIG. 9 is a perspective view of the upper region of the front quarter of a boot according to yet another aspect of the invention.

The latter is preferably shaped so that the span between the small block 301 and the upper border 302*a* of the slot is, with the block in position A, approximately equal to the span of the opposite free end of the slot 302 which corresponds to the position C of FIG. 9.

It is thus possible to regulate the quarter inclination during the flexing phase: in fact in position A the maximum inclination is allowed while in position C there is practically no inclination; position B allows an intermediate degree of inclination.

The slot 302 and the block 301 are covered by a plate 304, fixed to the quarter 303 by means of rivets or other coupling elements.

An opening 305 is provided in the plate 304, and a slider 306, rigidly associated with the small block 301, protrudes from said opening.

The function of the slider is to facilitate the grip and the movement of the block 301 on the part of the user.

The plate 304 has both an aesthetical function and a protective one. The engagement of the block 301 to the front quarter 303 is achieved with known snap-together means or with other solutions, for example such as the one illustrated in FIGS. 11 and 12 wherein a guide 308, for a tooth 309 which protruding from the block, is provided in said quarter.

Figure 12:
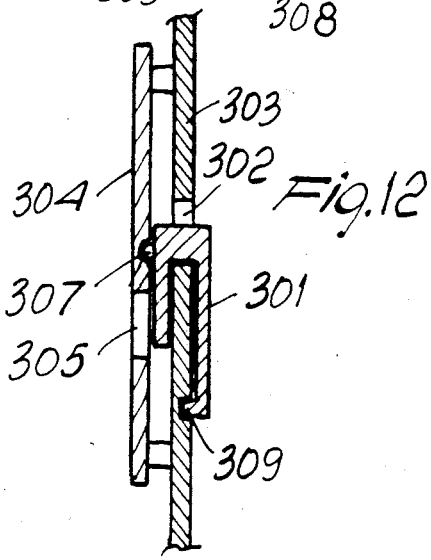
FIG. 12 is a cross section view along the line XII—XII of FIG. 10.
Figure 11:
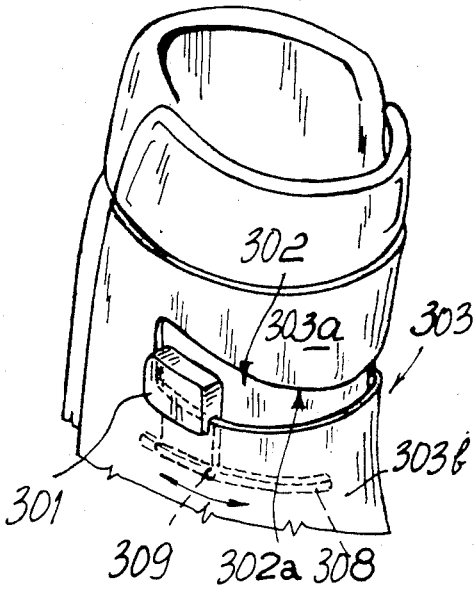
FIG. 11 is a partial perspective view of the front quarter of the boot of FIG. 9.

In order to secure the small block 301 in the desired position, different means may be used; for example the small block 301 can be provided with a lug 307 which engages in seats provided on the inner side of the plate 304, such as in the embodiment illustrated in FIG. 12.

The seats wherein the lug engages could also be provided in the quarter 303, for example at the guide 308.

The number of the seats naturally determines the number of possible positions for the small block 302 with respect to the slot.

Finally, the slot can be provided at any convenient height from the upper end of the quarter 303 according to the type of boot and of material used.

The operation of the device is simple: by acting on the slider 306 the small block 301 is moved from position A to position B, which is located proximate to the middle line for a symmetrical flexing, progressively limiting the flexing stroke.

With the block 301 in position A, a flexible boot will be obtained, having a soft tibial resting, since the free span of the slot 302 allows an elastic deformation of the front quarter 303.

With the block 301 in position B, a rigid boot will be obtained, since the span of the slot 302 in position B is equal to the height of the block 301 which in this position completely occludes said span, preventing the deformation of the quarter 303.

Naturally all intermediate positions of the block 301 between A and B are possible, and allow to vary the maximum deformation of the quarter 303, which depends on the free span between the small block 301 and the upper border 302*a* of the slot 302.

In practice it has been observed that the ski boot according to the invention achieves the intended aims since it allows a correct forward flexing of the leg, furthermore allowing an adjustment of the tibial resting.

The invention thus conceived is susceptible to numerous modifications and variations, all of which are within the scope of the invention concept; moreover, all the details may be replaced with technically equivalent elements.

In practice, the materials employed, as well as the dimensions, may be any according to the requirements and to the state of the art.

We claim:

1. A ski boot comprising a shell having a longitudinal axis and at least a front quarter connected to said shell, said front quarter comprising a first spoiler which is articulated to said shell and has an upper portion at least partially supporting the skier's lower leg and a lower portion at least partially embracing the instep portion of the skier's foot, said first spoiler having an upper edge with a depressed portion which defines a front opening for the passage of the tibia and a substantially planar surface which extends forwardly from said upper portion towards the tip of said shell, said front quarter further comprising a second spoiler which is associated with said first spoiler and has a front wall and a pair of lateral walls extending rearwardly from said front wall, at least one slot being provided on said front quarter proximate said upper edge of said first spoiler, wherein said second spoiler is so connected to said first spoiler to embrace said upper portion and to rest on said planar surface of said first spoiler, said slot beign provided on said second spoiler so as to extend along both said front and said lateral walls thereof to thereby define a front slot portion and a pair of lateral slot portions having a substantially constant width at rest position, said front slot portion extending substantially horizontally and transversely to said longitudinal shell axis while said lateral portions are inclined downwardly so as to form an acute angle with respect to said longitudinal shall axis, whereby on operation upon forward flexion of the skier's lower leg the skier's tibia is allowed to pass through said front opening of said first spoiler to directly interact with said second spoiler which is caused to elastically deformate along said slot portions by variation of the width thereof in order to adapt itself to the inclination of the skier's tibia and to absorb the impact of the tibia thereon.

2. A ski boot according to claim 1, further comprising means for adjusting the degree of deformability of said second spoiler by adjustment of the maximum width variation of said slot portions.

3. A ski boot according to claim 1, said front slot portion defining an upper and a lower border, said deformability adjustment means comprising a substantially longitudinal seat extending downwardly from said lower border substantially perpendicularly thereto, and further comprising an externally threaded stem rotatably accomodated in said seat for slidable movement with respect thereto.

4. A ski boot according to claim 3, wherein said externally threaded stem has an upper end which is at least partially protruding into said slot upwardly from said lower border thereof, a small plate being rigidly associated with said upper end of said stem to define an abutment surface for said upper border of said front slot portion.

5. A ski boot according to claim 4, wherein said deformability adjustment means further commprises a ferrule ring which is internally threaded complementarily with said externally threaded stem for cooperation therewith, a groove seat being formed on said front wall of said second spoiler to rotatably accomodate said ferrule ring while preventing axial movement thereof, said ferrule ring being so arranged in said groove seat to at least partially protrude outwardly thereof and to permit manual operation thereof.

6. A ski boot according to any preceeding claim, wherein the material forming said second spoiler has a greater elasticity than the material forming said first spoiler.

* * * * *

UNITED STATES PATENT OFFICE

CERTIFICATE OF CORRECTION

Patent No. 4,809,448 Dated March 7, 1989

Inventor(s) Valerio TONEL - Mario MATTIUZZO

It is certified that error appears in the above-identified patent and that said Letters Patent is hereby corrected as shown below:

On the title page;

Between item (22) and item (51), please insert:

--(30) Foreign Application Priority Data

Sep. 8, 1986 (IT) Italy ..... 59434 B/86

Mar.20, 1987 (IT) Italy ..... 82526 A/87--

Signed and Sealed this

Third Day of July, 1990

*Attest:*

*Attesting Officer*

HARRY F. MANBECK, JR.

*Commissioner of Patents and Trademarks*